United States Patent [19]

Ordmandy

[11] 4,370,010

[45] Jan. 25, 1983

[54] QUICK CHANGE MULTIPLE FUNCTION OUTLET

[76] Inventor: Robert L. Ordmandy, 43-26 159th St., Flushing, N.Y. 11358

[21] Appl. No.: 203,647

[22] Filed: Nov. 3, 1980

[51] Int. Cl.[3] ..... H01R 39/00

[52] U.S. Cl. ..... 339/31 R; 339/8 R

[58] Field of Search ..... 339/8 R, 7 R, 6 R, 31 R, 339/31 M, 176 M; 200/51.03

[56] References Cited

U.S. PATENT DOCUMENTS 3,321,729 5/1967 Phillips ..... 339/8 R

FOREIGN PATENT DOCUMENTS 495459 6/1954 Italy ..... 339/8 R

*Primary Examiner*—Eugene F. Desmond

*Attorney, Agent, or Firm*—Richard L. Miller

[57] ABSTRACT

A casing for an outlet receptacle is provided with a well that pivotally mounts the outlet receptacle so that the receptacle may be rotated 180 degrees. Electrical contacts within the well allow for connection from a constant power source to an intermittent one when the receptacle is rotated through 180 degrees.

6 Claims, 3 Drawing Figures

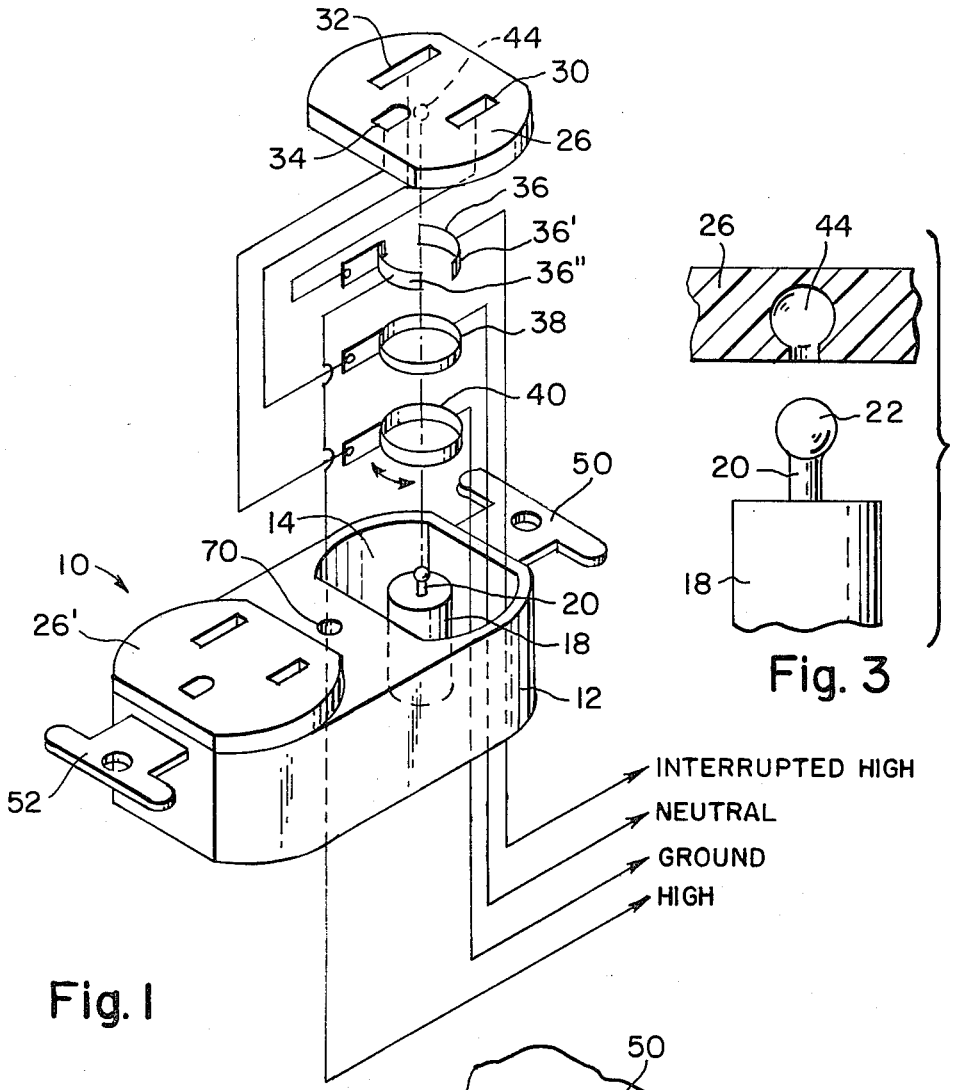
Fig. 1
Fig. 3
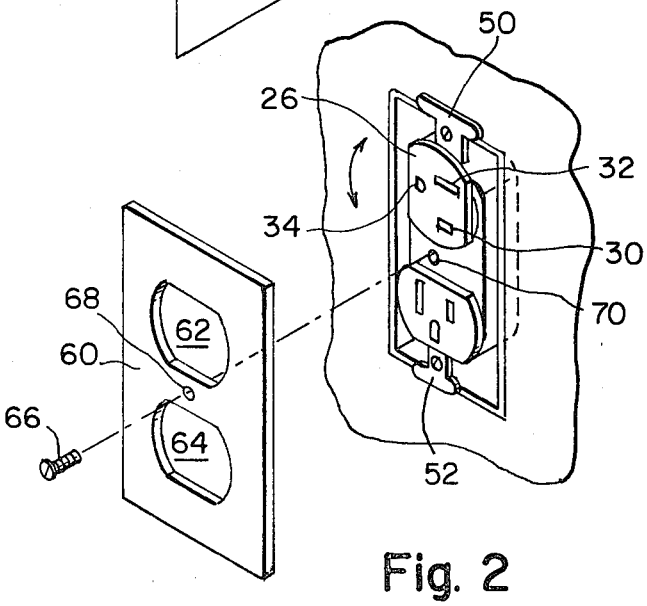
Fig. 2

QUICK CHANGE MULTIPLE FUNCTION OUTLET

BACKGROUND OF THE INVENTION

The present invention is directed to a wall outlet that has been connected to a power source via a switch that is in a wall, so that it may be alternately turned on and off by the switch. However, it is often desirable to allow for the choice of having the outlet connected either to the switch or directly to the conventional power source, and also to provide other outlets in the room with the same option of being controllable by either the switch or operated via the conventional power source directly.

SUMMARY OF THE INVENTION

It is, therefore, the object of the present invention to provide a wall outlet that may be readily converted from a first mode where the terminals of the outlet are directly connected to a conventional power source, to a second mode where the terminals are connected to a switch for intermittent operation. To this end, the outlet of the present invention has a receptacle that is pivotally mounted over a well of a casing, while electrical contact rings within the well provide the connection to either the conventional power source or the intermittent source or switch. There are three contact rings corresponding to the neutral, ground, and high terminals of the outlet, and contact wipers of the receptacle for connection to the contact rings. The high contact ring is divided into two separate portions, where one is connected to the conventional power source and the other to the switch for intermittant connection.

BRIEF DESCRIPTION OF THE DRAWING FIGURES

The invention will be more readily understood with reference to the accompanying drawing, wherein FIG. 1 is a exploded perspective view of the multiple function outlet of the present invention;

FIG. 2 is a perspective view of the invention mounted on a wall and the attachment plate for attaching the invention to the wall; and FIG. 3 is an enlarged detail view illustrating the pivotal mounting of the receptacle of the present invention.

DETAILED DESCRIPTION OF THE INVENTION

Referring now to FIGS. 1 and 2, the multiple function outlet of the present invention is shown with two similar receptacles, with only one being described below. The multiple function outlet 10 has a hard plastic casing 12 with a receptacle well 14, within which is mounted a pivot post 18. Pivot post 18 has an elongated extension 20 which terminates in an enlarged knob 22, as best seen in FIG. 3. Pivot post 18 allows for pivotal rotation of an outlet receptacle 26. Outlet receptacle 26 has openings 30, 32, and 34 for connection to the high, neutral and ground terminals, respectively, of the outlet. Contact is provided by contact rings 36, 38, 40 for high neutral, and ground terminals, respectively. Rings 38 and 40 are such that at any point about the circumference thereof, contact is established with the neutral and ground terminals of the outlet power source. However, contact ring 36 is divided into two semi-circular portions 36', 36''. When the wiper contact of the outlet receptacle, which is of conventional design, is in contact with the semi-circular portion 36'', electrical contact is made with the "Interupted High" mode of operation. That is, in this case contact is established with a switch that may control the power to the outlet receptacle 26, which switch may be, in typical fashion, mounted upon a wall of a room, or the like. When the wiper contact of the receptacle is in contact with semi-circular portion 36'', electrical contact is made with a constant, standard power source so that the receptacle will be in the "high" position, and thus operate in the standard fashion of typical wall outlets. The wiper contact of the receptacle 26 for contact with the contact ring 36 is rotated by means of the pivot post 18 and enlarged knob 22, which knob is received in a similarly shaped mating opening 44 of receptacle 26 (See FIG. 3).

FIG. 2 shows the multiple function wall outlet of the present invention mounted in a wall, and rotated 90 degrees from the normal "High" power oriented position, just before the outlet receptacle 26 is to be rotated to the desired "High" or "Interrupted High" mode of operation. As shown in FIG. 2, a 90 degree rotation of the receptacle 26 in the clockwise direction results in the "Interrupted High" mode of operation where the wiper contact of the receptacle will be in contact with the semi-circular portion 36''. A 90 degree rotation in the counterclockwise direction will result in the normal "High", or standard power source, mode of operation, where the wiper contact of the receptacle 26 will be in contact with the semi-circular portion 36''. When the mode of operation is in the "Interrupted High" state, the outlet is controlled by the switch attached to the wall of the room, or the like. When the mode of operation is in the "High" state, the outlet acts in the conventional manner and is a constant source of power.

The multiple function outlet of the present invention is mounted to the standard outlet on a wall, initially by flanges 50, 52, which may be fastened to the wall in the usual manner. The terminals themselves may be color coded, such as a light color for the neutral, and dark for the others. After the mode of operation is selected by rotating the receptacle in either the clockwise or counterclockwise direction, the receptacle is fixed in place by means of a plate 60 having openings 62, 64. Each opening 62, 64 is of similar shape to the two receptacles 26; that is, two opposite sides that are straight edged, and two opposite sides that are curved, as can be seen in FIG. 2. Thus, when the plate 60 is fixed in place over the receptacles 26 by conventional means, such as screw 66 through opening 68, and received in threaded opening 70 formed in the hard plastic casing 12 of the fixture, the receptacles 26 are locked in place, and prevented from rotating.

While the multiple function outlet of the present invention is shown with two multiple function receptacles, it may be made such that only one of the receptacles has a multiple function capability, while the other receptacle will be of the standard operating type.

It is therefore, seen, that a wall outlet is provided that can change its mode from a standard power outlet source to one that may be controlled by a switch to be in an "Interrupted" mode of operation.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A multiple function outlet comprising, in combination, a casing having a receptacle well formed therein; a receptacle for fitting over and closing off said receptacle well, said receptacle and said receptacle well having similarly shaped configurations for mating engagement therebetween; said casing having means for pivotally connecting said receptacle in said receptacle well; and electrical contact means for electrical contact with said receptacle for alternately and optionally connecting said receptacle to a constant power source or to an intermittent power source, wherein said electrical contact means comprises a first circular contact ring; a second circular contact ring mounted adjacent to said first electrical contact ring; and a third electrical contact ring mounted adjacent to second electrical contact ring, wherein said receptacle comprises a first opening for insertion therethrough of a first wiper contact for contact with said first electrical contact ring; a second opening for insertion therethrough of a second wiper contact for contact with said second circular electrical contact ring, and a third opening for insertion therethrough of a third wiper contact for contact with said third circular electrical contact ring, whereby, when said receptacle is rotated, said third wiper contact is displaced so as to change the power source from a constant one to an intermittent one, wherein said third circular contact ring comprises a first semi-circular portion for connection to a constant power source and a second semi-circular portion for connection to an intermittent power source, whereby rotation of said third wiper contact from said first portion to said second portion changes the mode of operation from constant to intermittent.

2. The multiple function outlet according to claim 1, wherein said first, second, and third circular contact rings are mounted within said receptacle well.

3. The multiple function outlet according to claim 2, wherein said means for pivotally connecting said receptacle to said receptacle well comprises a post extending vertically upwardly from the bottom of said casing toward said receptacle, and an elongated extension from said post, said elongated extension having at its end thereof an enlarged knob for insertion into a similarly shaped opening in said receptacle.

4. The multiple function outlet according to claim 3, wherein said casing comprises means for fastening said casing over a conventional outlet in a wall, and an attachment plate having at least one opening formed therein for fitting over said casing and said receptacle to thereby lock in place said receptacle in the position to which it had been rotated.

5. The multiple function outlet according to claim 4, wherein said opening of said attachment plate is of the same shape as said receptacle, so that said receptacle may not be rotated when locked in place.

6. The multiple function outlet according to claim 5, wherein said opening of said attachment plate has shape such that two opposite edges are straight and two opposite edges are curved.

* * * * *